US008393277B2

(12) United States Patent
Johnston et al.

(10) Patent No.: US 8,393,277 B2
(45) Date of Patent: Mar. 12, 2013

(54) AUTOMATIC CARRIAGE RETURN FOR EXHAUST REMOVAL SYSTEM

(76) Inventors: John Johnston, El Dorado Hills, CA (US); Brian Roe, Auburn, CA (US)

( * ) Notice: Subject to any disclaimer, the term of this patent is extended or adjusted under 35 U.S.C. 154(b) by 314 days.

(21) Appl. No.: 12/925,995

(22) Filed: Nov. 4, 2010

(65) Prior Publication Data

US 2011/0100250 A1 May 5, 2011

Related U.S. Application Data

(60) Provisional application No. 61/280,435, filed on Nov. 4, 2009.

(51) Int. Cl.
*F24F 7/00* (2006.01)
*B61C 11/00* (2006.01)

(52) U.S. Cl. ..... 105/30; 105/33; 104/230; 104/229; 104/238; 454/64

(58) Field of Classification Search ..... 105/30, 105/32, 33; 104/89, 91, 93, 108, 173.1, 117.1, 104/238, 178, 229, 230, 231, 232, 233, 234, 104/202, 112; 454/63, 64
See application file for complete search history.

(56) References Cited

U.S. PATENT DOCUMENTS 3,498,236 A * 3/1970 Meek ..... 105/30
3,675,583 A * 7/1972 Sobey et al. ..... 104/23.2
3,886,869 A * 6/1975 Tantlinger ..... 105/30
4,660,465 A * 4/1987 Jentzsch et al. ..... 454/64
5,092,228 A * 3/1992 Pfeiffer et al. ..... 454/63
5,362,273 A * 11/1994 Pfeiffer et al. ..... 454/63
5,542,250 A * 8/1996 Ball et al. ..... 60/315
5,679,072 A * 10/1997 Brodin et al. ..... 454/63

FOREIGN PATENT DOCUMENTS

WO WO 97/30801 * 8/1997

* cited by examiner

*Primary Examiner* — Mark Le
(74) *Attorney, Agent, or Firm* — Robert F Kramer

(57) ABSTRACT

An automatic carriage return for an exhaust removal system having a carriage that is configured to translate along a track tube, the carriage being coupled at a first end to an exhaust extraction hose, the second end of the exhaust extraction hose being coupled to a vehicle exhaust for directing exhaust from the vehicle out the track tube. The automatic carriage return includes a drive cable spanning along the track tube, and an engagement assembly coupled to the carriage. The engagement assembly has an engaged configuration and a non-engaged configuration with respect to the drive cable. A drive motor is coupled to the engagement assembly, and drives motion of the carriage along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Upon release of the extraction hose from the vehicle, the engagement assembly is configured to automatically activate to the engaged configuration to engage the drive cable.

19 Claims, 7 Drawing Sheets

AUTOMATIC CARRIAGE RETURN FOR EXHAUST REMOVAL SYSTEM

CROSS-REFERENCE TO RELATED APPLICATIONS

This application claims priority from U.S. provisional application Ser. No. 61/280,435, filed on Nov. 4, 2009, herein incorporated by reference in its entirety.

BACKGROUND OF THE INVENTION

1. Field of the Invention

The present invention relates generally to systems and methods for a vehicle exhaust extraction system. More particularly, the invention is directed to systems and methods for a vehicle exhaust extraction system with automatic return.

2. Description of the Related Art

Emergency vehicles, such as fire engines, typically have an exhaust removal/extraction system that is coupled to the exhaust of the vehicle while the vehicle is started in the bay of the station, and travels with the vehicle until the vehicle exits the vehicle bay, at which point the exhaust removal tube detaches from the vehicle. The exhaust removal carriage, which is generally carried along a track above the vehicle, remains at the exit of the bay until it is manually moved back to the bay entrance, where it awaits return of the vehicle.

Accordingly, an object of the present invention is to provide an automated system that automatically returns the exhaust extraction assembly to the rear of the bay upon release of the vehicle. Another object of the present invention is to provide a retrofit system that automatically returns the exhaust extraction assembly to the rear of the bay upon release of the vehicle. At least some of these objectives will be met in the following description.

BRIEF SUMMARY OF THE INVENTION

An aspect of the present invention is an automatic carriage return for an exhaust removal system. In one embodiment, the return is configured to be retrofit to an existing exhaust extraction system having a carriage that is configured to translate along a track tube, the carriage being coupled at a first end to an exhaust extraction hose, the second end of the exhaust extraction hose being coupled to a vehicle exhaust for directing exhaust from the vehicle out the track tube. The automatic carriage return includes a drive cable spanning along a path adjacent to and substantially parallel with the track tube, and an engagement assembly coupled to the carriage. The engagement assembly has an engaged configuration and a non-engaged configuration with respect to the drive cable. A drive motor is coupled to the engagement assembly, the drive motor being configured to drive motion of the carriage along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Wherein, upon release of the extraction hose from the vehicle, the engagement assembly is configured to automatically activate to the engaged configuration to engage the drive cable.

In one embodiment, at least one of the engagement assembly and drive motor are pneumatically driven. For example, the drive motor may comprise a pneumatic drive motor, and the engagement assembly comprises a pneumatic drive cylinder that is configured to drive the engagement assembly to and from the disengaged configuration to the engaged configuration.

In another embodiment, the engagement assembly comprises a lever arm housing one or more upper wheels, wherein the lever arm is configured to house the one or more upper wheels at an orientation that does not significantly deflect the drive cable in the disengaged configuration. In the engaged configuration, the lever arm is configured to engage the one or more upper wheels with the drive cable such that the drive cable deflects on to a drive wheel coupled to the drive motor.

In a further embodiment, a first sensor is coupled to the carriage and is configured to sense a first location of the carriage with respect to the track tube and send a signal to operate the pneumatic drive cylinder to engage the engagement assembly and the pneumatic drive motor to drive translation of the carriage along the drive cable.

In another embodiment, the return includes a motor controller valve, wherein the first sensor comprises a first trigger valve, and the motor controller valve is configured to sense a pneumatic signal from the first trigger valve. The motor controller valve is configured to control the delivery of air to the pneumatic drive motor and pneumatic drive cylinder to operate the pneumatic drive motor and pneumatic drive cylinder to operate upon receiving said pneumatic signal.

In one mode of the current embodiment, a second sensor comprising a second trigger valve is included that is configured to sense a second location of the carriage with respect to the track tube. The second trigger valve is configured to send a signal to the motor controller valve to operate the pneumatic drive cylinder to disengage the engagement assembly and the turn off pneumatic drive motor to stop translation of the carriage along the drive cable.

Another aspect is an exhaust removal system with automatic carriage return, comprising a carriage being coupled at a first end to an exhaust extraction hose, wherein the carriage is configured to translate along a track tube. A second end of the exhaust extraction hose is configured to be coupled to a vehicle exhaust for directing exhaust from the vehicle out the track tube; A drive cable spans along a path adjacent to and substantially parallel with the track tube. An engagement assembly is coupled to the carriage, the engagement assembly having an engaged configuration and a non-engaged configuration with respect to the drive cable. A drive motor coupled to the engagement assembly, the drive motor being configured to drive motion of the carriage along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Upon release of the extraction hose from the vehicle, the engagement assembly is configured to automatically activate to the engaged configuration to engage the drive cable.

In one embodiment of the current aspect, the drive motor comprises a pneumatic drive motor, and the engagement assembly comprises a pneumatic drive cylinder that is configured to drive the engagement assembly to and from the disengaged configuration to the engaged configuration.

In a further embodiment, a first sensor is coupled to the carriage and is configured to sense a first location of the carriage with respect to the track tube. The first sensor is configured to send a signal to release the second end of the exhaust extraction hose from the vehicle exhaust. The first sensor is further configured to send a second signal to operate the pneumatic drive cylinder to engage the engagement assembly and the pneumatic drive motor to drive translation of the carriage along the drive cable.

Another aspect is a method for automatically returning a carriage for an exhaust removal system. The method includes the steps of coupling a first end of the carriage to an exhaust extraction hose, coupling a second end of the exhaust extraction hose to a vehicle exhaust for allowing the carriage to translate along a track tube as the vehicle moves in a first direction while directing exhaust from the vehicle out the track tube, releasing a second end of the exhaust extraction hose from the vehicle exhaust, engaging a drive cable with an engagement assembly coupled to the carriage, wherein the drive cable spans along a path adjacent to and substantially parallel with the track tube. The engagement assembly has an engaged configuration and a non-engaged configuration with respect to the drive cable. The method further includes driving motion of the carriage in a second direction opposite to the first direction along the drive cable when the engagement assembly is in the engaged configuration. In the disengaged configuration, the engagement assembly is configured to be disengaged from the drive cable while the exhaust extraction hose is attached to the exhaust of a vehicle to allow the carriage to freely follow the path of the vehicle. Upon release of the extraction hose from the vehicle, the engagement assembly is configured to automatically activate to the engaged configuration to engage the drive cable.

In one embodiment of the current aspect, engaging a drive cable and driving motion of the carriage are done pneumatically.

In another embodiment, the method includes sensing a first location of the carriage with respect to the track tube, sending a pneumatic signal to release the second end of the exhaust extraction hose from the a vehicle exhaust, and sending a second signal to operate a pneumatic drive cylinder to engage the engagement assembly and the pneumatic drive motor to drive translation of the carriage along the drive cable.

In another embodiment, the method includes sensing a second location of the carriage with respect to the track tube, and sending a third signal to operate the pneumatic drive cylinder to disengage the engagement assembly and the turn off pneumatic drive motor to stop translation of the carriage along the drive cable.

Further aspects of the invention will be brought out in the following portions of the specification, wherein the detailed description is for the purpose of fully disclosing preferred embodiments of the invention without placing limitations thereon.

DETAILED DESCRIPTION OF THE INVENTION

The present invention, detailed in FIGS. 1 to 6 below, is directed to devices and methods for automatic return of the carriage and extraction hose portion of an exhaust removal system to the entrance side of a drive-through vehicle bay after it has been pulled to the exit side by a departing vehicle.

Figure 1:
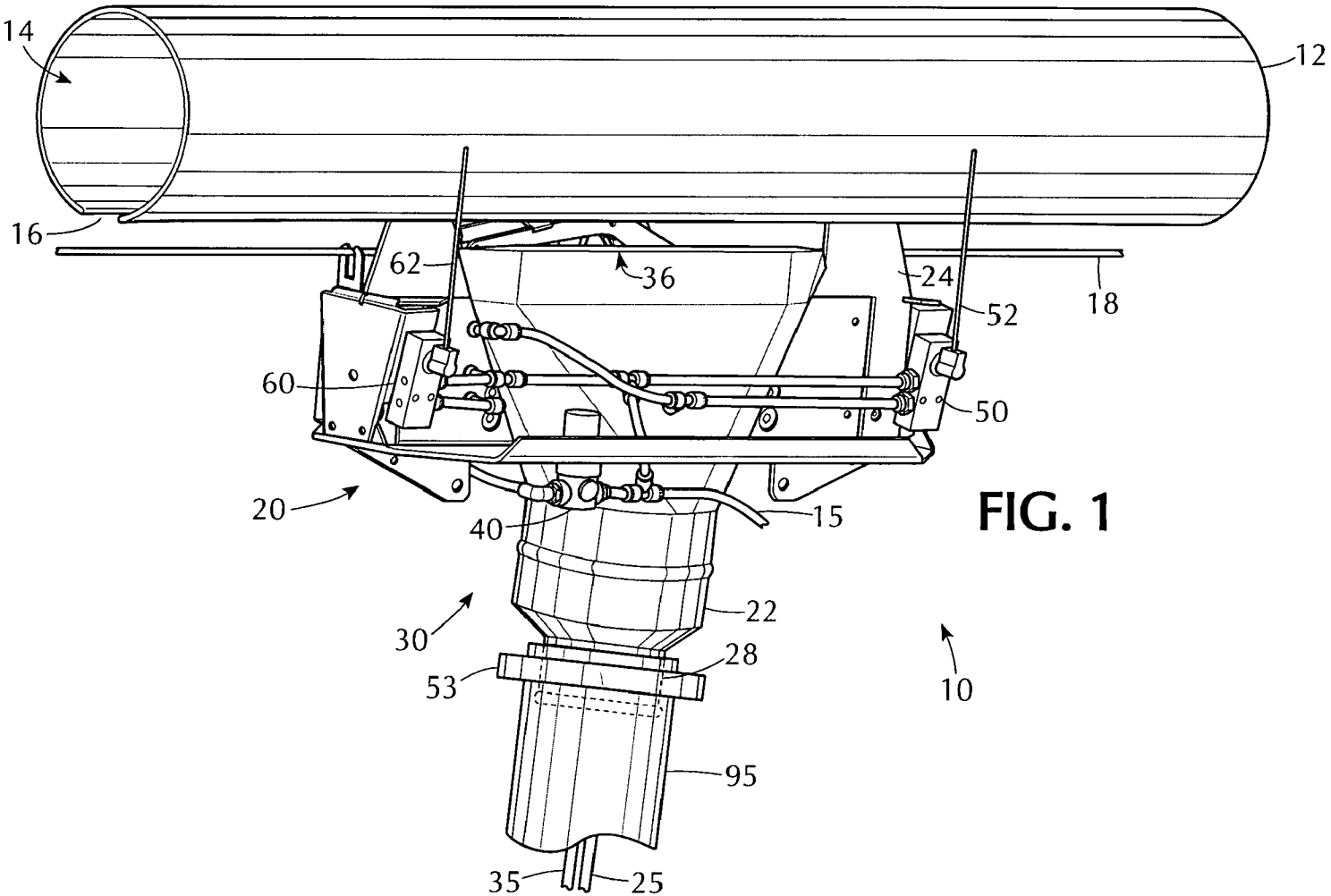
FIG. 1 is a perspective view of the control side of the automatic carriage return of the present invention.
Figure 2:
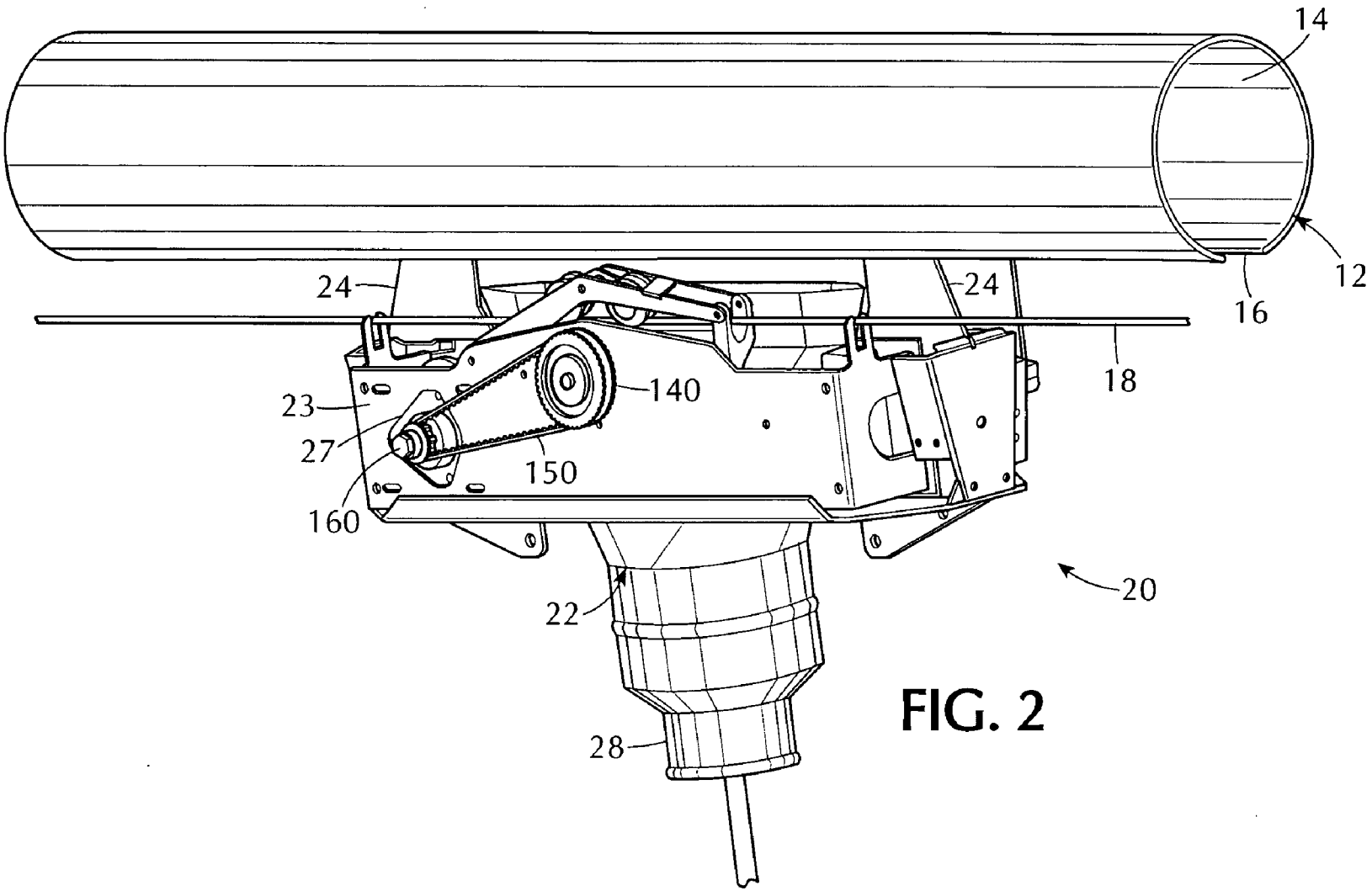
FIG. 2 is a perspective view of the drive side of the automatic carriage return of FIG. 1.
Figure 3:
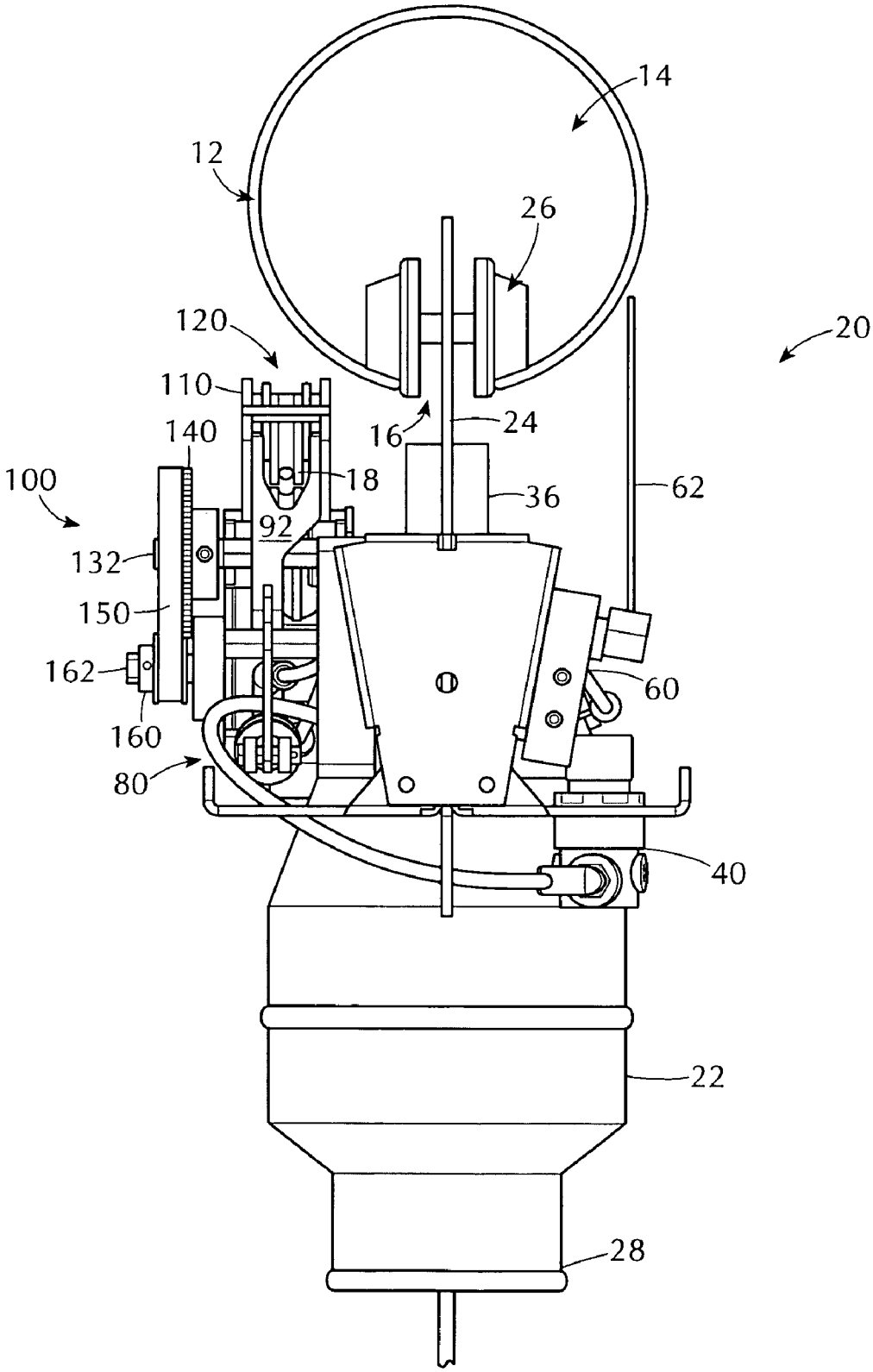
FIG. 3 is a rear perspective view of the automatic carriage return of FIG. 1.
Figure 4:
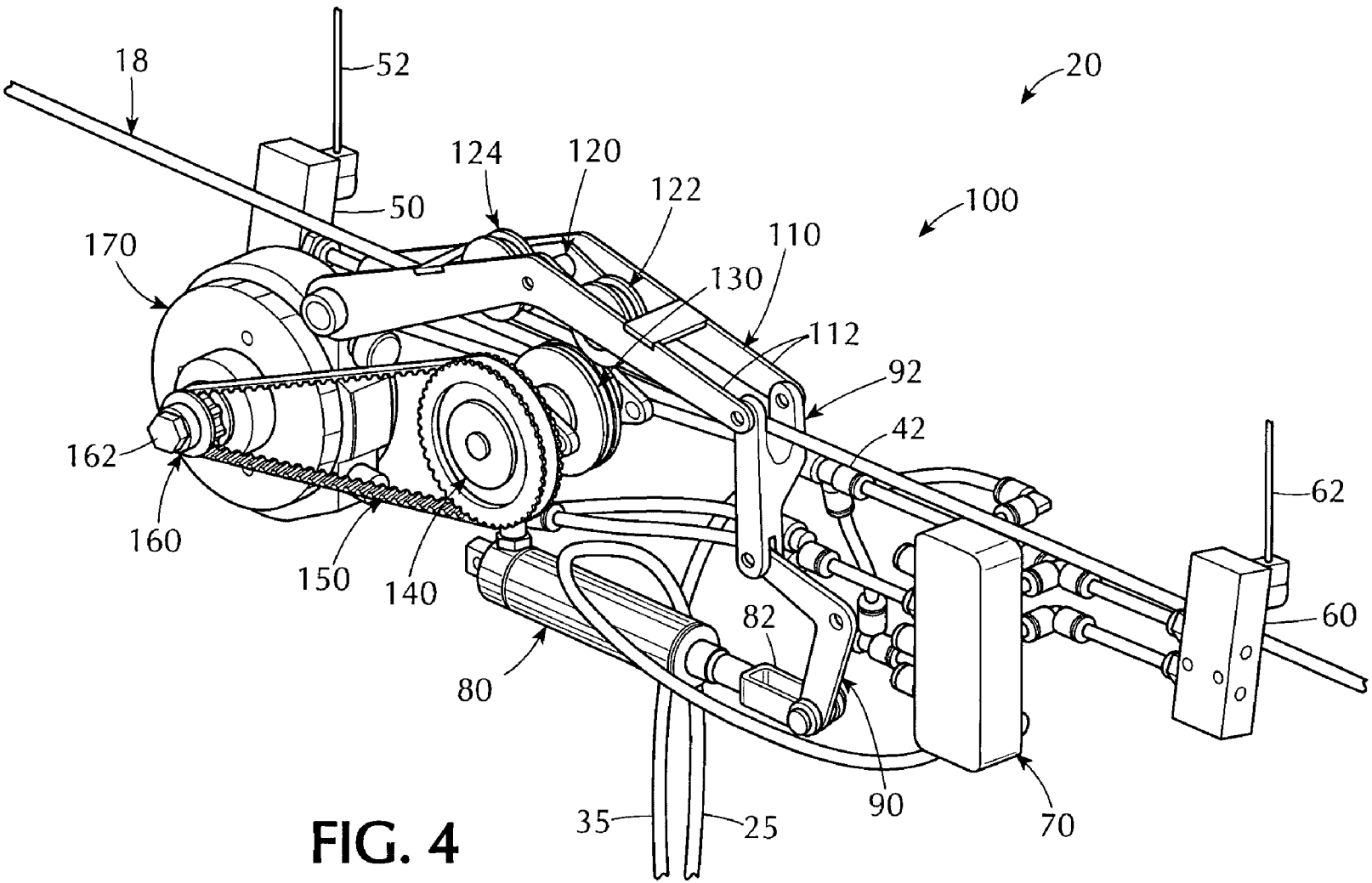
FIG. 4 is a perspective view of the drive side of the automatic carriage return of FIG. 1 with the carriage, track tube and main support bracket removed to show better detail.

FIGS. 1-4 show various views of an exhaust removal system 10 incorporating the automatic carriage return 20 of the present invention. FIGS. 1 and 2 show perspective views of the control side and drive side, respectively, of the automatic carriage return 20. FIG. 3 shows a rear view of the automatic carriage return 20, and FIG. 4 is a perspective view of the drive side of the automatic carriage return with the carriage fairing 22, track tube 12, and main support bracket 23 removed to show better detail.

The exhaust removal system 10 comprises an exhaust removal hose 95 that is detachably coupled to the exhaust pipe (not shown) of a service vehicle (not shown). The opposite end of the exhaust hose 95 is coupled to a bottom end 28 of carriage fairing 22 via collar or clamp 53. The carriage fairing 22 is configured to direct exhaust upward and out slotted upper end 36 toward slot 16 in track tube 12. The track tube comprises a central channel 14 to receive the exhaust.

Referring to FIG. 3, the carriage 22 is configured to translate freely in a linear fashion across the bay via two sets of track wheels 26 that are disposed within in the central channel 14 of track tube 12. The track wheels 26 are rotatably attached to brackets 24 that couple the wheels 26 to the main support bracket 23. Thus, while the exhaust extraction hose 95 is coupled to the vehicle, it is the vehicles motion that drives motion of the carriage 22 along the track tube 12.

The return system 20 of the present invention is configured to only engage upon release of the exhaust extraction hose 95 from the exhaust of the vehicle, thus allowing the carriage assembly 30 to move freely within track tube 12. Furthermore, the return system 20 comprises an engagement assembly 100 and drive means that are powered entirely via a pneumatic air system that used for disengagement/release of the exhaust hose 95 from the truck upon exiting the bay.

Figure 6:
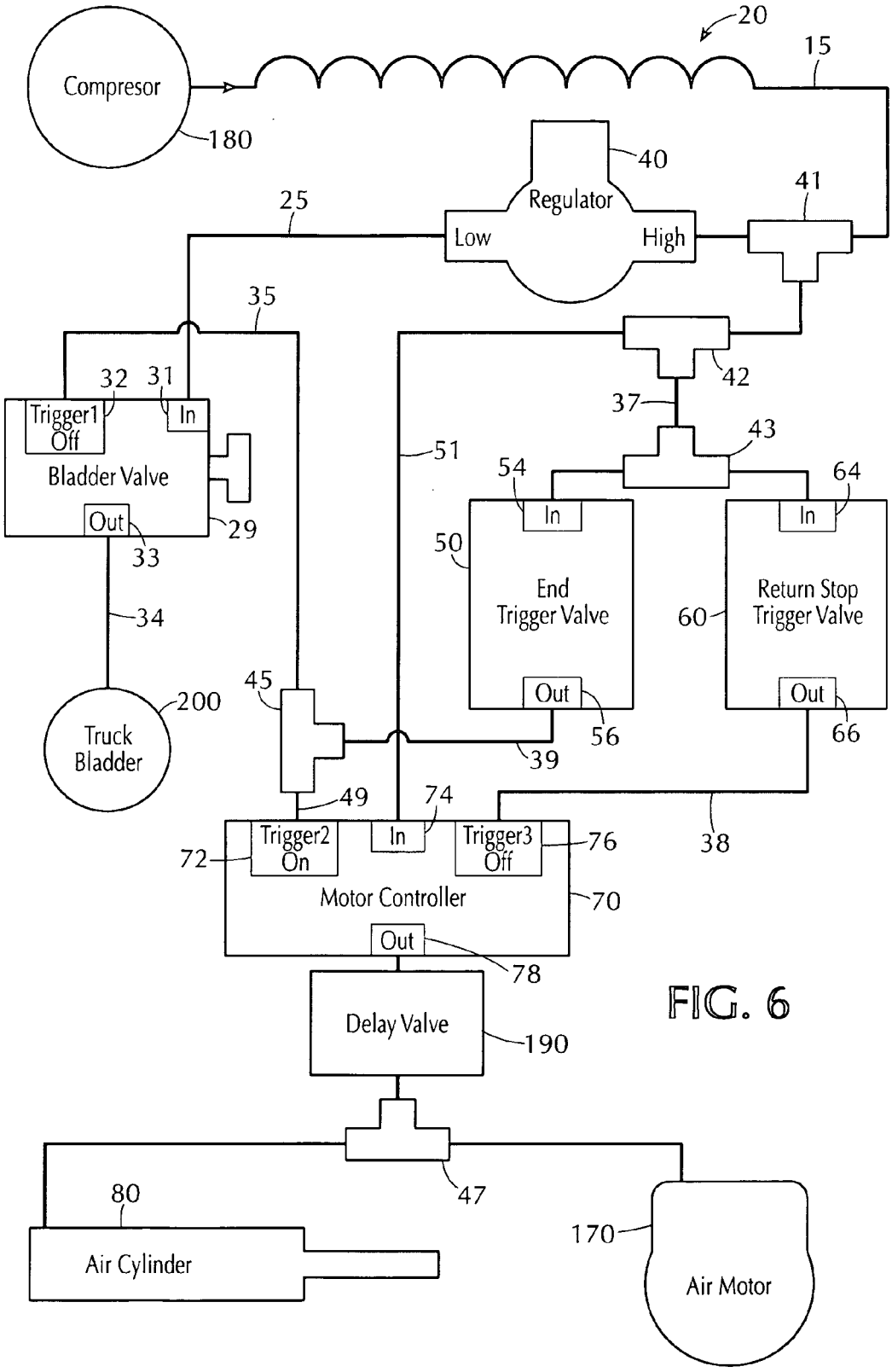
FIG. 6 illustrates a system air flow chart of the automatic carriage return of the present invention.

As detailed in FIGS. 1 and 6, the exhaust removal system 10 uses a retention bladder 200 to couple the exhaust hose 95 to the truck exhaust. The system takes high pressure air from the input tube 15 and directs the pressurized air to pressure regulator 40 to send low pressure to the bladder 200. A portion of the high pressurized air is directed to end trigger valve 50. Upon the vehicle reaching the exit side of the bay, end trigger valve 50 is activated from pivotable arm 52 rotating after hitting a stop (not shown), indicating the location of the carriage 30 at the end of the bay. Once activated, the trigger valve 50 is then sends a pressure signal via a release signal tube 45 to the bladder valve 29 (FIG. 6). The carriage return system 20 is further configured such that the end trigger valve 50 also sends a signal to activate the automatic return 20.

Figure 5A:
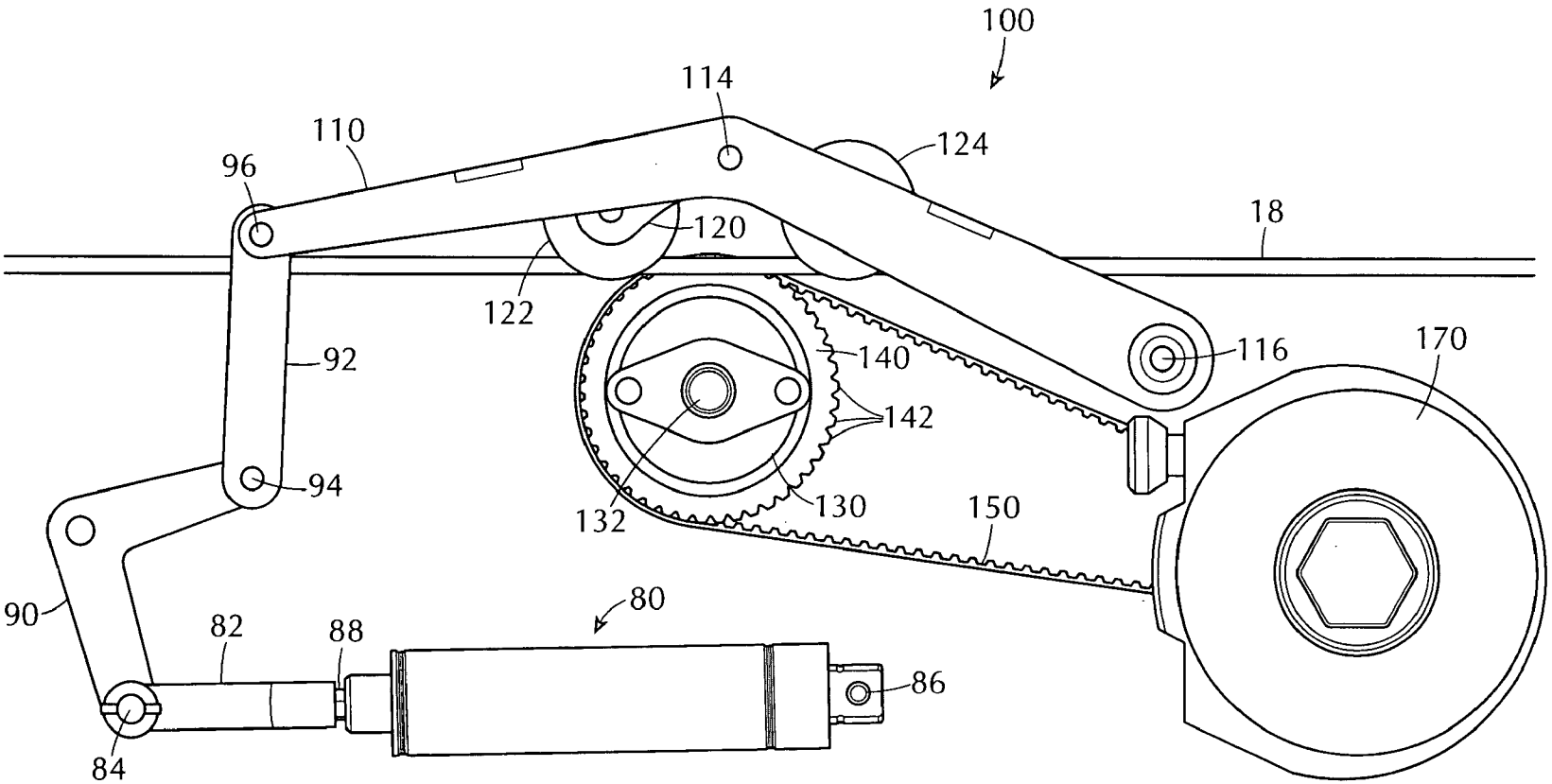
FIG. 5A is a side view of the of the automatic carriage return of FIG. 1 with the engagement mechanism disengaged.
Figure 5B:
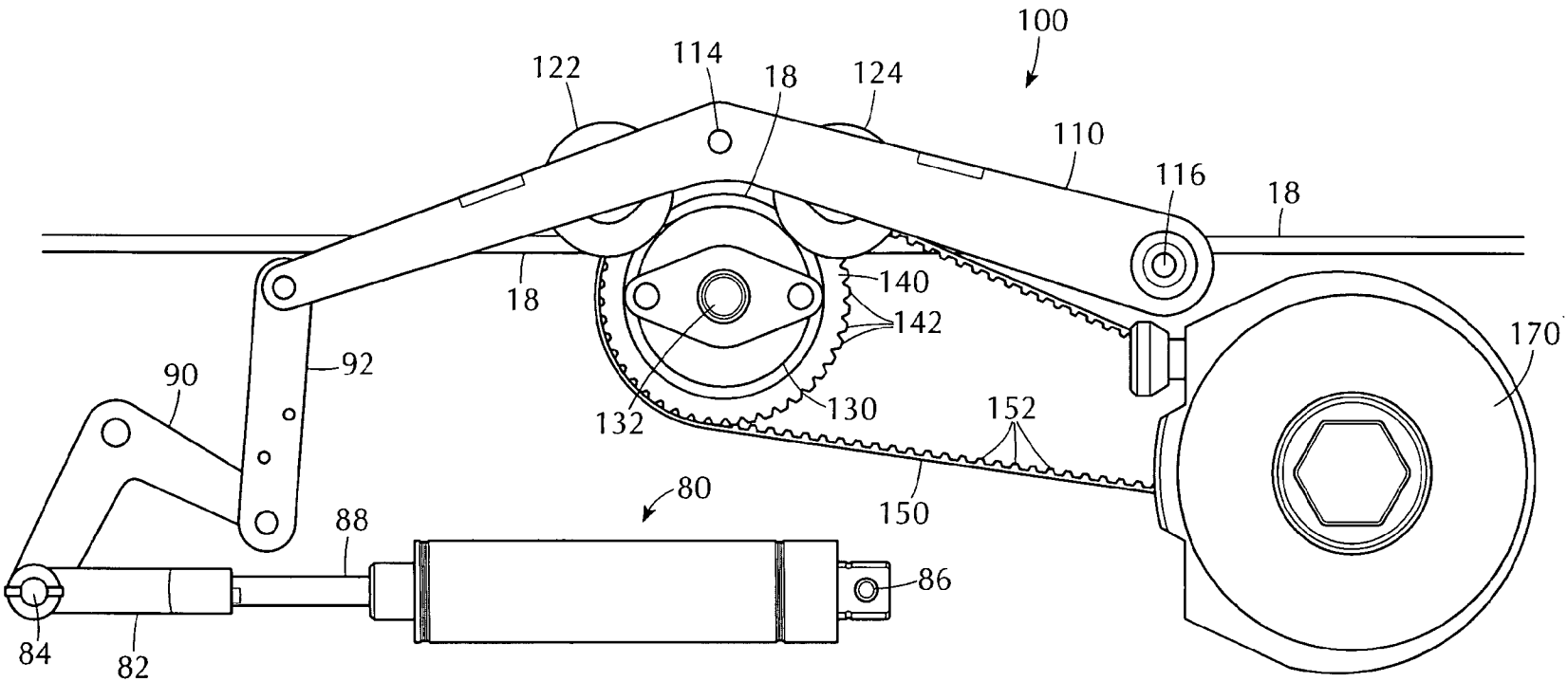
FIG. 5B is a side view of the of the automatic carriage return of FIG. 1 with the engagement mechanism engaged.

Referring now to FIGS. 4, 5A and 5B, the signal from end trigger valve 50 is sent to motor controller valve 70, which is configured to send high pressure air the pneumatic cylinder 80 and the pneumatic drive motor 170 to operate engagement and return drive means. FIGS. 4 and 5A illustrate the engagement mechanism 100 in a disengaged configuration. In this mode, the carriage assembly 30 is free to translate along the length track tube 12 without any, or substantially any, restriction from the return drive means. The return drive mechanism of the carriage assembly 30 is affected from contact between the drive wheel 130 and drive cable 18, wherein the position of the bogey 120 dictates whether or not the drive wheel 130 is in contact with the drive cable 18. As seen in FIGS. 1, 2 and 3, drive cable 18 spans across the bay along an axis substantially parallel to the axis of the track tube 12, at a location below and to one side of the track tube 12. During the disengaged mode illustrated in FIGS. 4 and 5A, the drive cable has minimal to no contact with the bogey wheels 130, 140 of bogey 120.

Referring now to FIG. 5B, the signal from end trigger valve 50 (triggered from the carriage assembly 30 reaching the end trigger valve 50) is sent to the motor controller valve 70, which sends high pressure air the pneumatic cylinder 80 and the pneumatic drive motor 170 to operate engagement and return drive means. The high pressure air drives the pneumatic cylinder 80 extend piston 88. The pneumatic cylinder 80 has a fixed end 86 that is restrained from translation, thus causing the piston 88 to push rod clevis 82 outward from the cylinder body. Motion of the rod clevis 82 applies a corresponding rotation to the crank arm 90 which is pivotably connected rod clevis pivot 84. The downward motion of crank arm 90 correspondingly pulls down on the Y Bar 92, which is coupled to the crank arm 90 at pivot 94. The Y Bar 92 is pivotably attached to free end of lever or bogey arms 110 at hinge 96, such that downward motion of the Y Bar 92 pivots the bogey arm 110 lowering the bogey 120 and bogey wheels 122,124 until they contact (or push down if already in contact) the drive cable 18. The opposing end of the bogey 120 is pivotably fixed at hinge 116 such that continued downward motion of the bogey arm 110 causes the drive cable 18 to be pinched between the bogey wheels 122, 124 and the drive wheel 130 (see FIG. 5B, showing the drive cable 18 being bent around drive wheel 130. This pinching action creates the friction necessary to drive the carriage assembly 30 forward along the drive cable 18 when the drive wheel 130 is rotated.

It is appreciated that prior to this engagement (which is triggered by release of the extraction hose from the vehicle), the return system 20 of the present invention in no way impedes the natural motion of the carriage assembly 30 as it follows the vehicle out the bay.

Rotation of the drive wheel 130 is accomplished by high pressure air traveling through the pneumatic drive motor 170, causing the output shaft 162 to rotate. The rotating shaft 162 is connected to the small toothed pulley 160. The rotation of the small toothed pulley 160 is transmitted via the toothed belt 18 to the large toothed pulley 140. The large toothed pulley 140 is directly coupled through a cross shaft to the drive wheel 130. Corresponding rotation of the large toothed pulley 140 directly rotates the drive wheel 130. Thus, the carriage assembly 30 is powered by the drive wheel 130 and drive cable 18 when in the engaged configuration of FIG. 5B, and travels down the track tube 12 towards the entrance side of the bay.

Upon reaching the entrance side of the bay, the pivoting arm 62 of trigger valve 60 rotates as it engages a stop (not shown) at or near the entrance. The motion of arm 62 activates stop trigger valve 60, sending a signal to the motor controller valve 70. The motor controller valve 70 then turns off the pressure supply to the pneumatic cylinder 80 and the pneumatic drive motor 170. This loss in pressure stops the rotation of the pneumatic drive motor 170 and causes the pneumatic cylinder 80 to retract pivot 88. The retraction of the cylinder pivot 88 correspondingly drives the engagement assembly linkage back to the disengaged configuration of FIG. 5A, releasing the pinch of bogey 120 on the drive cable 18. The carriage 30 now remains at the entrance side of the bay until it is pulled by a reconnected vehicle to the exit side of the bay where the return sequence starts again.

FIG. 6 illustrates flow chart of the air control of the carriage return 20 system of the present invention, wherein air from compressor 180 is feed to modulator 40, trigger valves 50, 60, motor controller 70, bladder valve 29, retention bladder 200, cylinder and motor 170.

It is appreciated that trigger valves 50, 60 are essentially sensors that detect the position of the carriage assembly 30, and send a pneumatic signal to valves 29, and 70 to operate or control various mechanical components of the system. While this configuration is advantageous in that it provides a sensing means that does not require any electrical power (and associated cables and/or batteries), it is understood that other sensors (e.g. pressure, optical, hall-effect sensors, RFID, or the like) available in the art may be used interchangeably with the return system 20 of the present invention.

As detailed in FIG. 6, high pressure air enters the system through the input tube 15 and travels to T-fitting 41, which splits the airflow between the pressure regulator 40 and a second T-fitting 42. Low pressure then travels from the pressure regulator 40 down the bladder valve tube 25 (see also FIG. 1) to input 31 of the bladder valve 29, where it inflates the retention bladder 200 (FIG. 6) to hold the extraction hose 95 to the vehicle's exhaust pipe (not shown).

Second T-fitting 42 splits airflow between line 37 and a third T-fitting 43 that supplies air to the inputs 54, 64 of respective end trigger valve 50 and return stop trigger valve 60, and line 51, which directs airflow to input 74 of motor controller 70.

Upon the vehicle reaching the exit side of the bay, end trigger valve 50 is activated, sending a pneumatic pressure signal through output 56 and line 39 to fourth T-fitting 45. Fourth T-fitting 45 splits the airflow between trigger 2 "on" input 72 of motor controller 70 and the release signal line 35 (see FIG. 1) coupled to trigger 1 "off" input 32 of the bladder valve 29. This trigger 1 "off" signal cuts air off of the output 33 and line 34 leading to retention bladder 200, causing the retention bladder 200 to deflate, thereby releasing the extraction hose 95 from the vehicle's exhaust pipe.

Simultaneous with sending the trigger 1 "off" signal, the air from output 56 of the end trigger valve 50 is also sent via the fourth T-fitting 45 out line 49 to the trigger 2 "on" input 72 of motor controller 70 to activate the automatic return 20. The signal from the trigger 2 "on" input 72 (indicating that the vehicle has reached the exit side of the bay and pending release of the bladder 200 from the vehicle exhaust) activates the motor controller valve 70 to send high pressure air through output 78 to delay valve 190. The delay valve 190 suspends the transmission of the air to T-fitting 47 for a specified period of time (e.g. 5 seconds). The delay period may be varied, but only needs to be enough time sufficient to ensure that the bladder 200 has been released from the vehicle exhaust before engagement of the return system 200. After the specified delay, the air is split at T-fitting 47 between the air cylinder 80 and the pneumatic drive motor 170 to activate engagement assembly 100 and radial motion of drive motor 170. The engagement assembly 100 then engages cable 18 and drives the carriage assembly 30 along track 12 toward the entrance of the bay.

Upon reaching the entrance side of the bay, the arm 62 of return stop trigger valve 60 is activated, which releases air through output 66 and line 38 to the trigger 3 "off" input 76 of the motor controller valve 70. The motor controller valve 70 then cuts off the pressure supply from output 78 to the pneumatic cylinder 80 and the pneumatic drive motor 170. This loss in pressure stops the rotation of the pneumatic drive motor 170 and causes the pneumatic cylinder 80 to retract pivot 88. The retraction of the cylinder pivot 88 correspondingly drives the engagement assembly linkage back to the disengaged configuration of FIG. 5A, releasing the pinch of bogey 120 on the drive cable 18. The carriage return assembly 30 is now free to translate along track tube 12 so that it may be free to move once the hose 95 is attached to the vehicle exhaust.

The above illustrated embodiment of automatic carriage return 20 is illustrated in FIGS. 1-6 to be installed as a retro-fit to an existing pneumatically-operated exhaust removal system that may already be in play en the emergency vehicle bay. In such case, the engagement assembly 100, motor controller 70 delay valve 190, air cylinder 80, air motor 170 return stop trigger valve 60, and accompanying fittings and lines are installed to attach to, or work in concert with, already existing regulator 40, bladder valve 29, bladder 200, end trigger valve 50, track tube 12 carriage fairing 22, main bracket, etc. Certain parts may be modified to allow for such retrofit. For example, the main bracket 32 may be modified to provide opening (clearance) 27 for small-toothed pulley 160.

However, it is appreciated that may comprise an exhaust removal system 10 comprising a carriage return system 20 as an integrated component.

Furthermore, the automatic carriage return 20 illustrated in FIGS. 1-6 is configured to operate pneumatically via pressurized air. However, it is appreciated that the principles of the present invention may be applied to systems using other driving or sensing means, e.g. electronic server motor, electromagnetic actuation, etc., or may include a mixture of components that are pneumatically operated and components using other drive/sensing means. In addition, it is appreciated that certain components may be interchangeably used with other components known in the art. For example, while the bogey/drive cable is a preferred engagement means for affecting return drive of the carriage assembly 30, it is possible that other possible releasable engagement means (e.g. rack and pinion, worm drive, etc) may be used as well.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An automatic carriage return for an exhaust removal system having a carriage that is configured to translate along a track tube, the carriage being coupled at a first end to an exhaust extraction hose, the second end of the exhaust extraction hose being coupled to a vehicle exhaust for directing exhaust from the vehicle out the track tube, the automatic carriage return comprising:

a drive cable spanning along a path adjacent to and substantially parallel with the track tube;

an engagement assembly coupled to the carriage, the engagement assembly having an engaged configuration and a disengaged configuration with respect to the drive cable; and a drive motor coupled to the engagement assembly, the drive motor being configured to drive motion of the carriage along the drive cable when the engagement assembly is in the engaged configuration;

wherein in the disengaged configuration, the engagement assembly is configured to be disengaged from the drive cable while the exhaust extraction hose is attached to the exhaust of a vehicle to allow the carriage to freely follow the path of the vehicle;

wherein, upon release of the extraction hose from the vehicle, the engagement assembly is configured to automatically activate to the engaged configuration to engage the drive cable.

2. An automatic carriage return as recited in claim 1, wherein at least one of the engagement assembly and drive motor are pneumatically driven.

3. An automatic carriage return as recited in claim 2, wherein the drive motor comprises a pneumatic drive motor.

4. An automatic carriage return as recited in claim 3, wherein the engagement assembly comprises a pneumatic drive cylinder that is configured to drive the engagement assembly to and from the disengaged configuration to the engaged configuration.

5. An automatic carriage return as recited in claim 1, wherein the engagement assembly comprises a lever arm housing one or more upper wheels;

wherein the lever arm is configured to house the one or more upper wheels at an orientation that does not significantly deflect the drive cable in the disengaged configuration; and wherein in the engaged configuration, the lever arm is configured to engage the one or more upper wheels with the drive cable such that the drive cable deflects on to a drive wheel coupled to the drive motor.

6. An automatic carriage return as recited in claim 4, further comprising:

a first sensor coupled to the carriage;

the first sensor configured to sense a first location of the carriage with respect to the track tube;

wherein the first sensor is configured to send a signal to operate the pneumatic drive cylinder to engage the engagement assembly and the pneumatic drive motor to drive translation of the carriage along the drive cable.

7. An automatic carriage return as recited in claim 6, further comprising:

a motor controller valve;

wherein the first sensor comprises a first trigger valve;

wherein motor controller valve is configured to sense a pneumatic signal from the first trigger valve; and wherein the motor controller valve is configured to control the delivery of air to the pneumatic drive motor and pneumatic drive cylinder to operate the pneumatic drive motor and pneumatic drive cylinder to operate upon receiving said pneumatic signal.

8. An automatic carriage return as recited in claim 7, further comprising:

a second sensor comprising a second trigger valve;

the second sensor configured to sense a second location of the carriage with respect to the track tube;

wherein the second trigger valve is configured to send a signal to the motor controller valve to operate the pneumatic drive cylinder to disengage the engagement assembly and the turn off pneumatic drive motor to stop translation of the carriage along the drive cable.

9. An exhaust removal system with automatic carriage return, comprising:

a carriage;

an exhaust extraction hose;

the carriage being coupled at a first end to the exhaust extraction hose;

wherein the carriage is configured to translate along a track tube;

wherein a second end of the exhaust extraction hose is configured to be coupled to a vehicle exhaust for directing exhaust from the vehicle out the track tube;

a drive cable spanning along a path adjacent to and substantially parallel with the track tube;

an engagement assembly coupled to the carriage, the engagement assembly having an engaged configuration and a non-engaged configuration with respect to the drive cable; and a drive motor coupled to the engagement assembly, the drive motor being configured to drive motion of the carriage along the drive cable when the engagement assembly is in the engaged configuration;

wherein in the disengaged configuration, the engagement assembly is configured to be disengaged from the drive cable while the exhaust extraction hose is attached to the exhaust of a vehicle to allow the carriage to freely follow the path of the vehicle; and wherein, upon release of the extraction hose from the vehicle, the engagement assembly is configured to automatically activate to the engaged configuration to engage the drive cable.

10. An exhaust removal system as recited in claim 9, wherein at least one of the engagement assembly and drive motor are pneumatically driven.

11. An exhaust removal system as recited in claim 10, wherein the drive motor comprises a pneumatic drive motor; and wherein the engagement assembly comprises a pneumatic drive cylinder that is configured to drive the engagement assembly to and from the disengaged configuration to the engaged configuration.

12. An exhaust removal system as recited in claim 11, wherein the engagement assembly comprises a lever arm housing one or more upper wheels;

wherein the lever arm is configured to house the one or more upper wheels at an orientation that does not significantly deflect the drive cable in the disengaged configuration; and wherein in the engaged configuration, the lever arm is configured to engage the one or more upper wheels with the drive cable such that the drive cable deflects on to a drive wheel coupled to the drive motor.

13. An exhaust removal system as recited in claim 11, further comprising:

a first sensor coupled to the carriage;

the first sensor configured to sense a first location of the carriage with respect to the track tube;

wherein the first sensor is configured to send a signal to release the second end of the exhaust extraction hose from the vehicle exhaust;

wherein the first sensor is further configured to send a second signal to operate the pneumatic drive cylinder to engage the engagement assembly and the pneumatic drive motor to drive translation of the carriage along the drive cable.

14. An exhaust removal system as recited in claim 13, further comprising:

a motor controller valve;

wherein the first sensor comprises a first trigger valve;

wherein motor controller valve is configured to sense a pneumatic signal from the first trigger valve; and wherein the motor controller valve is configured to control the delivery of air to the pneumatic drive motor and pneumatic drive cylinder to operate the pneumatic drive motor and pneumatic drive cylinder to operate upon receiving said pneumatic signal.

15. An exhaust removal system as recited in claim 14, further comprising:

a second sensor comprising a second trigger valve;

the second sensor configured to sense a second location of the carriage with respect to the track tube;

wherein the second trigger valve is configured to send a signal to the motor controller valve to operate the pneumatic drive cylinder to disengage the engagement assembly and the turn off pneumatic drive motor to stop translation of the carriage along the drive cable.

16. A method for automatically returning a carriage for an exhaust removal system, comprising:

coupling a first end of the carriage to an exhaust extraction hose;

coupling a second end of the exhaust extraction hose to a vehicle exhaust for allowing the carriage to translate along a track tube as the vehicle moves in a first direction while directing exhaust from the vehicle out the track tube;

releasing a second end of the exhaust extraction hose from the vehicle exhaust;

engaging a drive cable with an engagement assembly coupled to the carriage;

the drive cable spanning along a path adjacent to and substantially parallel with the track tube;

the engagement assembly having an engaged configuration and a non-engaged configuration with respect to the drive cable;

driving motion of the carriage in a second direction opposite to the first direction along the drive cable when the engagement assembly is in the engaged configuration;

wherein in the disengaged configuration, the engagement assembly is configured to be disengaged from the drive cable while the exhaust extraction hose is attached to the exhaust of a vehicle to allow the carriage to freely follow the path of the vehicle; and wherein, upon release of the extraction hose from the vehicle, the engagement assembly is configured to automatically activate to the engaged configuration to engage the drive cable.

17. A method as recited in claim 16, wherein engaging a drive cable and driving motion of the carriage are done pneumatically.

18. A method as recited in claim 17, further comprising:

sensing a first location of the carriage with respect to the track tube;

sending a pneumatic signal to release the second end of the exhaust extraction hose from the a vehicle exhaust; and sending a second signal to operate a pneumatic drive cylinder to engage the engagement assembly and the pneumatic drive motor to drive translation of the carriage along the drive cable.

19. An exhaust removal system as recited in claim 18, further comprising:

sensing a second location of the carriage with respect to the track tube; and sending a third signal to operate the pneumatic drive cylinder to disengage the engagement assembly and the turn off pneumatic drive motor to stop translation of the carriage along the drive cable.

* * * * *